United States Patent [19]

Root et al.

[11] Patent Number: 4,481,122

[45] Date of Patent: Nov. 6, 1984

[54] LUBRICANT COMPOSITIONS

[75] Inventors: Jon C. Root, Leawood; John F. Barnes; Dennis M. Rosson, both of Olathe, all of Kans.

[73] Assignee: Witco Chemical Corporation, New York, N.Y.

[21] Appl. No.: 477,014

[22] Filed: Mar. 21, 1983

[51] Int. Cl.[3] ..... C10M 5/10

[52] U.S. Cl. ..... 252/32.7 E; 252/49.6; 252/50; 252/51; 585/10

[58] Field of Search ..... 252/32.7 E, 49.6, 50, 252/51; 585/10

[56] References Cited

U.S. PATENT DOCUMENTS

| | | | |
|---|---|---|---|
| 3,838,049 | 9/1974 | Souillard et al. | 585/10 |
| 3,852,204 | 12/1974 | Souillard et al. | 585/10 |
| 3,933,657 | 1/1976 | Seni et al. | 585/10 |

*Primary Examiner*—Jacqueline V. Howard

*Attorney, Agent, or Firm*—Wallenstein, Wagner, Hattis, Strampel & Aubel

[57] ABSTRACT

Lubricant compositions adapted for use in lubricating traction motor gears comprising a major proportion of a base oil such as a mineral oil, and a minor proportion of an oil soluble polymer such as a polyisobutylene.

5 Claims, No Drawings

LUBRICANT COMPOSITIONS

TECHNICAL FIELD

The present invention relates to lubricant compositions, and, in particular, to lubricant compositions for use in lubricating traction motor gears of the type found in Diesel locomotives.

BACKGROUND OF THE PRIOR ART

Heretofore, lubricants for use in lubricating traction motor gears of the type employed in Diesel locomotives have comprised asphalt-oil blends, or petroleum resin-oil blends, which have been thickened with a metallic soap such as a sodium or lithium soap. These lubricants often contain extreme pressure additives, as well as corrosion and oxidation inhibitors, and antifoaming agents. An important disadvantage of soap thickened asphalt-oil, and petroleum resin-oil, based traction motor gear lubricants centers on their incompatibility with the oils used to lubricate the bearings of the traction motor. More specifically in this connection, if, due to poor gear box intergrity resulting from a defective or worn seal, leakage of the thickened lubricant occurs, and, as a result, the lubricant migrates along the traction motor armature and into contact with the motor bearing, failure of the bearing is inevitable. Replacement of the bearing is a time consuming and costly operation. A further noteworthy disadvantage of such soap thickened traction motor gear lubricants is their inability to provide proper lubrication at low temperatures. Thus, at freezing, or below freezing, temperatures the soap thickened lubricants have a gelled, or solid, consistency. In this state, they are ineffective as a gear lubricant. It is only after the gear box has heated up that the lubricants begin to perform their intended function. Yet another disadvantage encountered in the use of soap thickened traction motor gear lubricants, especially the asphalt-oil based types, is their tendency to oxidize. Oxidation acts to solidify the lubricant, rendering it useless as a lubricant, and requiring its immediate replacement. A still further disadvantage of soap thickened traction motor gear lubricants is the need for packaging them in containers, usually plastic bags, which are placed into the gear box. The action of the gears, coupled with the heat generated in the gear box, causes the bags to disintegrate thereby releasing the lubricant. The need for bags adds significantly to the manufacturing costs of the lubricants.

BRIEF SUMMARY OF THE INVENTION

The present invention provides lubricant compositions which are uniquely adapted for use in lubricating traction motor gears. Not only are the lubricant compositions of this invention capable of providing excellent lubrication over a wide temperature range, but, also, they have extreme pressure properties which enable them to remain stable even after prolonged use at the high pressures and temperatures encountered in Diesel locomotive gears. Their extreme pressure capabilities are complimented by their resistance to oxidation, and other chemical attack, both in use, and during periods of non-use. In addition, they do not require packaging in bags as is the case with soap thickened lubricants. The elimination of soap thickeners and heavy fluids significantly improves the low temperature lubrication properties of the compositions. The elimination of bags, of course, represents an important reduction in material and labor costs in the manufacture of the lubricant compositions of this invention.

The lubricant compositions of the present invention, in brief, comprise a major proportion of a base oil, preferably a mineral oil, and a minor proportion of an oil soluble polymer, the polymer being present in an amount sufficient to impart improved temperature tolerance and anti-leak properties to the compositions. In the preferred embodiments of the invention, minor proportions of additives in the form of oxidation inhibitors, load carrying substances, pour depressants, and antifoaming agents are incorporated into the compositions. In those cases in which the compositions are intended for use under less severe operating conditions, where product life is not a factor, a portion of the base oil may be substituted by thickening agents such as petroleum resins, or even asphalt.

DETAILED DESCRIPTION OF THE INVENTION

The base oils employed in the preparation of the lubricant compositions advantageously are petroleum derived lubricating oils. Especially preferred are mineral oils of the bright stock type having viscosities of about 140 SUS to about 225 SUS at 210° F. Higher viscosity grades of lubricating oils of the so called neutral and naphthenic types can also be used. The base oil, as indicated, comprises the major proportion, usually about 80% to about 96%, by weight, of the compositions.

The oil soluble polymers used in preparing the lubricant compositions can be selected from a wide group. Exemplary of polymers having utility in the practice of the present invention are polyisobutylenes, ethylene-propylene copolymers, hydrogenated styrene-isoprene copolymers, styrene-butadiene copolymers, hydrogenated styrene-butadiene copolymers, polymethyl methacrylate, polyethyl methacrylate, and styrene-methyl methacrylate copolymers, to mention a few. While the molecular weight of the polymer is not a critical consideration, it is preferred to use polymers of relatively low molecular weight for improved shear stability. As used herein, the term "low molecular weight" means a molecular weight of about 5,000 to about 20,000 (Staudinger). Of the foregoing polymers, a particularly preferred polymer is the polyisobutylene available under the designation "Vistanex LM-MS" (Exxon). This product is sold in the form of a viscous semi-solid having a molecular weight of the order of 8,700 to 10,000 (Staudinger). Polymers sold under the "Vistanex" as well as other designations such as, for example, "Ortholeum" (Du Pont) having molecular weights ranging from 25,000 to 140,000 (Staudinger) can also be used, but are less preferred due to possible degradation of the polymer under the shear forces encountered in traction motor gears. Mixtures of low, and high, molecular weight polymers can be used in achieving the objectives of this invention.

As stated, the oil soluble polymer comprises a minor proportion of the lubricant compositions of this invention. The generally optimum objectives of the invention are achieved with polymer proportions of the order of about 2% to about 40%, preferably about 5% to about 20%, by weight, of the compositions.

The performance characteristics, as well as the stability of the lubricant compositions can be enhanced and augmented by the inclusion of minor amounts of various additives into the compositions. Thus, the extreme pressure or load carrying capabilities of the lubricant compositions, along with the resistance of the compositions to deterioration or aging due to oxidation, can be improved by adding a metal substituted dialkyl- or diaryl-dithiophosphate to the compositions. Products which can be used are sold commercially under the designations "Lubrizol 1395", "Lubrizol 677A" (Lubrizol), "Hitec E-682" (Edwin Cooper), and "Vanlube 71" (R. T. Vanderbilt). Other compounds such as lead diamyl-dithiocarbamate, zinc diamyl-dithiocarbamate and antimony diamyl-dithiocarbamate may also be used. Also useful as load carrying additives are sulfur-phosphorus gear oil additives based on sulfurized fats and polymers such as polyolefins and phosphate esters. Oxidiation inhibitors, other than the dithiophosphates and dithiocarbamates named above, which can be employed include hindered phenols such as 2,6 di- tertiary butyl paracresol, and phosphite esters such as triphenyl phosphite. Also useful for this purpose are various aromatic amines such as diphenyl amine, alkylated diphenylamine, phenyl-alpha-naphthylamine and phenyl-beta naphthylamine, aminophenols, phenols, and polymerized quinolines.

The proportion of the load carrying additive used can range from about 1% to about 10%, usually about 2% to about 5%, by weight, of the composition. In those instances where an oxidation inhibitor other than a dithiophosphate or dithiocarbamate is added to the compositions, the proportion of the inhibitor will range from about 1% to about 10%, desirably about 2% to 8%, by weight, of the composition.

Other additives which can be incorporated into the compositions to improve their properties are pour depressants and antifoam agents. Pour depressants significantly extend the lower operating temperature range of the compositions. Exemplary of pour depressants which can be used are the polymethacrylates sold under the tradename "Acryloid" (Rohm & Haas). Also useful is the alkylated styrene sold under the designation O A-100 (Pearsall division of Witco). Other pour depressants are available under the designations "Hitec E-672" (Edwin Cooper), and "Paraflow 149" (Exxon).

Antifoaming agents having utility for the purposes of this invention include silicone types such as dimethyl silicone, and the organsilicones available commercially under the designations "Union Carbide L-7500", "Dow Corning 200" and "General Electric SF96".

The proportion of pour depressant employed in the compositions can range from about 0.1% to about 2%, preferably about 1% to about 1.5%, by weight, of the composition. The quantity of antifoaming agent used can vary between about 0.001% to about 1%, usually about 0.05% to about 0.5%, by weight, of the composition.

As indicated above, in those instances in which the compositions of the present invention are intended for ultimate use under less severe operating conditions than those encountered in the lubrication of traction motor gears, and where product life is not a factor, a portion of the base oil may be substituted by a thickening agent such as a petroleum resin or asphalt. In such cases, upwards of about 30% to about 75%, by weight, of the composition may comprise such a thickening agent.

Illustrative formulations, representing the best embodiments of the invention, are shown in the following examples and feature the foregoing materials and compounds in which the ingredients are set forth in the following percentages by weight:

EXAMPLE 1

| Ingredient | Percentage |
|---|---|
| Mineral oil (140 SUS @ 210° F., Bright Stock) | 89.19 |
| Polyisobutylene (VISTANEX LM-MS) | 7.50 |
| Dimethyl silicone (antifoaming agent) | 0.01 |
| Zinc dialkyl dithiophosphate (HITEC E-682) | 2.80 |
| Pour depressant (HITEC E-672) | 0.50 |

Approximately two thirds of the mineral oil is blended with the polyisobutylene at 160° F. for 30 minutes. The heat is removed and the remaining mineral oil and additives are blended into the oil-polymer solution over a period of 30 minutes. The viscosity if checked, and adjusted with oil or polymer as needed to provide a composition having a viscosity of approximately 500 SUS at 210° F.

EXAMPLE 2

| Ingredient | Percentage |
|---|---|
| Mineral Oil (140 SUS @ 210° F., Bright Stock) | 93.0 |
| Ethylene-propylene copolymer (Ortholeum 2035) | 2.5 |
| Lead diamyl dithiophosphate (Vanlube 71) | 2.0 |
| Organosilicone (Union Carbide L-7500) | 0.5 |
| Diphenylamine (oxidation inhibitor) | 2.0 |

The ingredients were processed as in Example 1.

Given the above teachings and illustrative examples thereof, it will be apparent to those skilled in the art that various lubricant compositions can be prepared in light of the guiding principles and teachings provided herein without departing from the spirit and scope of the present invention.

What is claimed is:

1. A lubricant grease composition for use in lubricating traction motor gears employed in Diesel locomotives, comprising: about 80% to about 96% by weight of a mineral oil having a viscosity of about 140 to about 225 SUS at 210° F.; about 5% to about 20% by weight of an oil soluble polymer having a molecular weight of about 5000 to about 140,000 Staudinger; about 1% to about 10% by weight of a metal substituted dialkyl- or diaryl-dithiophosphate, or a metal substituted dialky-dithiocarbamate, or an aromatic amine about 0.1% to about 2% by weight of a polymethylacrylate or alkylated styrene pour depressant; and about 0.001% to about 1% by weight of an organosilicone antifoaming agent; said composition being in the form of a grease having extreme pressure properties which enable it to remain stable after prolonged use at the high pressures and temperatures encountered in traction motor gears of Diesel locomotives, and being capable of providing excellent lubrication at freezing or below freezing termperatures.

2. A lubricant grease composition according to claim 1 wherein the oil soluble polymer is a polyisobutylene having a molecular weight of about 5,000 to about 20,000 Staudinger 3. A lubricant grease composition according to claim 1 wherein about 30% to about 75% by weight of the mineral oil is replaced by a petroleum resin or asphalt.

4. A lubricant grease composition according to claim 1 wherein the grease composition has a viscosity of about 500 SUS at 210° F.

5. A lubricant grease composition according to claim 1 wherein the oil soluble polymer is an ethylene-propylene copolymer.

* * * * *